United States Patent [19]

Mitchell

[11] Patent Number: 4,471,641

[45] Date of Patent: Sep. 18, 1984

[54] METHOD AND MEANS OF CONTINUOUSLY PUNCHING, SHEARING AND FORMING SHEET MATERIAL

[76] Inventor: James L. Mitchell, 920 Market St., Carlisle, Iowa 50047

[21] Appl. No.: 441,444

[22] Filed: Nov. 15, 1982

[51] Int. Cl.[3] ..... B21D 5/08; B21B 1/24; B26D 1/56

[52] U.S. Cl. ..... 72/132; 72/181; 72/185; 72/187; 83/300; 83/320; 83/405

[58] Field of Search ..... 72/130, 132, 179, 181, 72/196, 197, 198, 337, 338, 339, 185, 187, 326; 83/300, 319, 320, 314, 405, 55n

[56] References Cited

U.S. PATENT DOCUMENTS

| | | | |
|---|---|---|---|
| 3,797,428 | 3/1974 | Nordgren et al | 72/326 |
| 3,886,779 | 6/1975 | McClain | 72/181 |
| 4,027,517 | 6/1977 | Bodnar | 72/185 |

FOREIGN PATENT DOCUMENTS

| | | | |
|---|---|---|---|
| 2738136 | 3/1979 | Fed. Rep. of Germany | 83/319 |

*Primary Examiner*—E. Michael Combs

*Assistant Examiner*—Charles Rosenberg

*Attorney, Agent, or Firm*—Zarley, McKee, Thomte, Voorhees & Sease

[57] ABSTRACT

A machine for continuously punching, shearing and forming sheet material comprises a frame and punching, shearing, and forming stations. Rollers are provided for continuously feeding sheet material through the stations. A cam periodically engages the tools of the respective punching and shearing stations to actuate the respective punching and shearing operations and simultaneously to advance the respective punching and shearing stations in unison with the direction of feed of the sheet material. The forming station includes adjustable rollers which permit adjustment of the space between the rollers. The method of the present invention comprises continuously feeding the sheet material through the punching, shearing, and forming stations. At the punching and shearing stations, the tools for punching and shearing the sheet material move in unison with the sheet material during the time that they are performing their punching and shearing operations, respectively.

11 Claims, 6 Drawing Figures

METHOD AND MEANS OF CONTINUOUSLY PUNCHING, SHEARING AND FORMING SHEET MATERIAL

BACKGROUND OF THE INVENTION

Conventional machines used in the forming of sheet metal, such as channel-shaped studs for building walls, typically require that the stock material be stopped while the punching, shearing and forming operations are performed. The quantity of output was therefore less than if the material moved continuously through the machine as the operations were performed. Also, different dies are usually necessary to produce output with differing dimensions. The changing of dies is a time consuming and costly procedure. Also, existing machines for forming sheet metal are very large and are suitable only for factory usage.

It is therefore a primary objective of the present invention to provide a method and means of continuously punching, shearing and forming sheet material so that the progression of the material through the device is continuous.

A further object of the present invention is to provide a method and means of continuously punching, shearing and forming sheet metal whereby the lateral width of the end product can be easily varied.

A further object of the present invention is the provision of a method and means of continuously punching, shearing and forming sheet material in which all three operations are performed within one portable device which can function at the construction site.

A further object of the present invention is the provision of a method and means of continuously punching, shearing and forming sheet material which is easy to use and safe in operation.

SUMMARY OF THE INVENTION

The present invention provides a method and means of continuously punching, shearing and forming sheet material. The punching and shearing stations of the machine each move on rollers between a first nonoperational position and a second operational position such that as the portion is performing its operation it moves with the sheet material until the operation is completed. When operation is completed, a spring forces the portion back to its first nonoperational position. The forming station of the machine comprises a plurality of rollers having variable sizes and deflection angles such that a channel is gradually formed in the material. The distance between the roller sets can be adjusted so that the width of the channel can be varied.

DETAILED DESCRIPTION OF THE DRAWINGS

Figure 1:
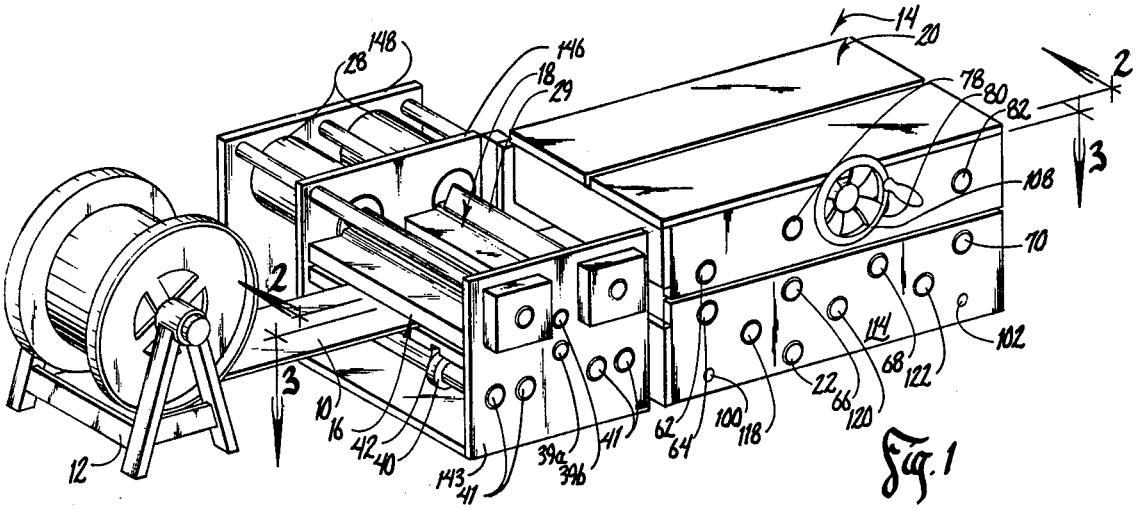
FIG. 1 is a perspective view of a machine for continuously punching, shearing and forming sheet material.
Figure 2:
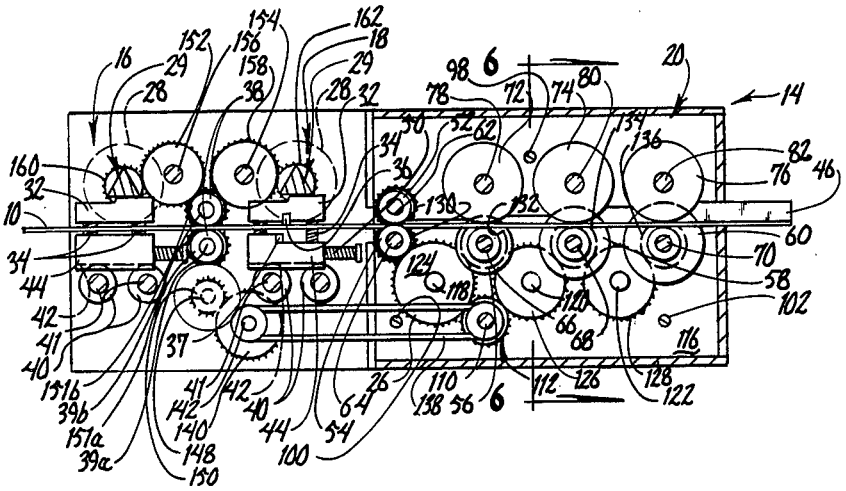
FIG. 2 is a partial sectional view of the machine taken along lines 2—2 of FIG. 1.
Figure 3:
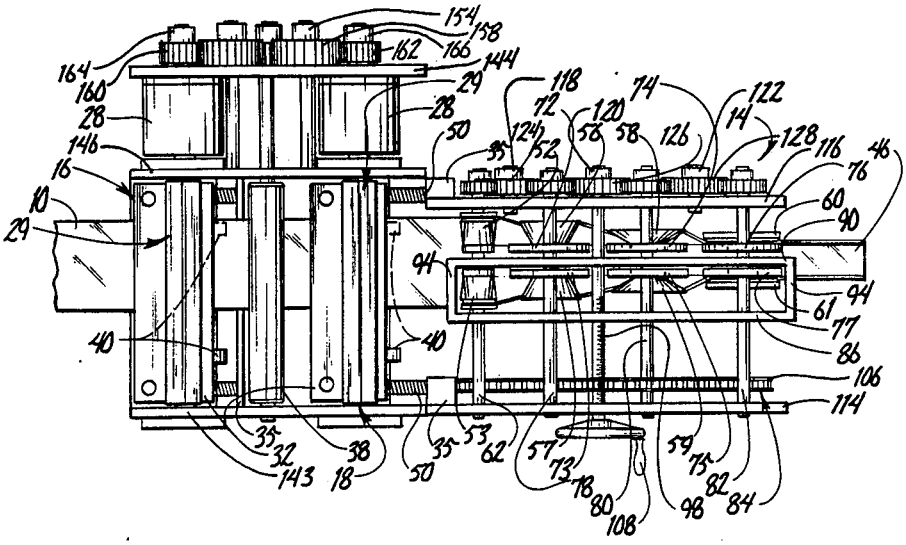
FIG. 3 is a partial top plan view of the machine without the cover on the forming station taken along line 3—3 of FIG. 1.

The numeral 10 designates the sheet material; the numeral 12 designates a support stand for the roll of sheet material, and the numeral 14 generally represents the machine of this invention which continuously punches, shears and forms the sheet material 10. In FIG. 2, the numeral 16 generally designates the punching station of the machine 14, the numeral 18 generally designates the shearing station of the machine 14 and the numeral 20 generally designates the forming station of the machine 14.

Punch station 16 and shear station 18 are mounted on machine 14 with the punch station 16 at the end receiving the sheet metal 10 and the shear station 18 adjacent to the punch station. The stations are aligned so that the sheet metal linearly progresses from the punch station to the shear station punch station 16 punches holes, indentations or the like into the sheet material and shear station 18 shears the material to desired lengths as the material progresses through the respective station.

Punch station 16 and shear station 18 operate similarly. Each has a clutch mechanism 28 operatively connected thereto with a cam 29 that periodically engages the punching or shearing die so that its respective operation is performed. The punching station 16 and shearing station 18 each have an identical advancement means that will be further described with reference to FIG. 4.

Figure 4:
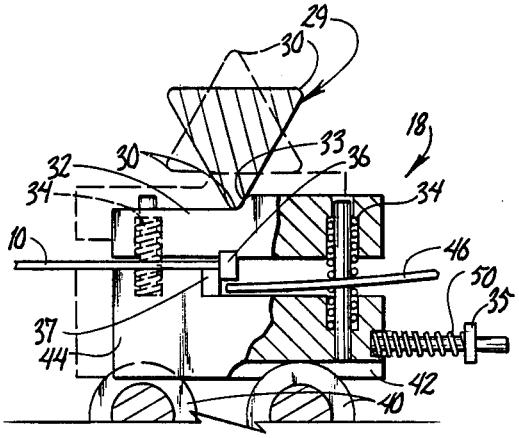
FIG. 4 is an enlarged scale view of the continuous advancement means of the shearing station of the machine.

In FIG. 4, a first nonoperational position of the shearing station 18 is shown by dotted lines. As the triangular tip 30 of cam 29 comes into operational contact with the upper plate 32 of shear portion 18, springs 34 are compressed as upper plate 32 is forced downward. As tip 30 continues its counterclockwise movement and contacts lip 33 of upper plate 32, the opposing cutting edges 36 and 37 come into contact with material 10, which is being advanced by rollers 38 mounted on shafts 39. While tip 30 engages lip 33 of upper plate 32, the counterclockwise movement of tip 30 forces upper plate 32 and lower plate 44 of shearing station 18 forward into its operational second position upon rollers 40 mounted on shafts 41 which are journaled within grooves 42 in lower plate 44. When tip 30 disengages lip 33, the shearing operation is complete, springs 34 force upper plate 32 upwardly, and spring 50, having one end attached to lower plate 44 and the other end attached to flange 35, urges shearing portion 18 back to its nonoperational first position. The sheared portion 46 of sheet material 10 is further advanced by rollers 52–53 and 54–55. This process is repeated each time a tip of cam 29 comes into operational engagement with upper plate 32.

The channel forming station 20 is mounted on machine 14 adjacent the shearing station 18 and is aligned with shearing station 18 and punching station 16 so that the sheet metal will continue its linear progression through the machine 14. The channel forming station 20 has five sets of rollers 52–53, 54–55, 56–57, 58–59, and 60–61 which are used to form the channel in the sheet material 10. Each set of rollers has a corresponding shaft 62, 64, 66, 68 and 70 spanning the width of machine 14 and about which the rollers rotate. These rollers, with the exception of rollers 52–53, are located below the sheet material and form the upward channel as the material progresses through the rollers. In corresponding vertical alignment with rollers 56–57, 58–59 and 60–61 are three sets of guide rollers 72–73, 74–75, and 76–77 mounted on shafts 78, 80 and 82, respectively. The diameter of the rollers progressively increases as the sheet metal moves through station 20, with 52–53 having the smallest diameter and 60–61 having the largest diameter. The angle of deflection, that is the angle between the roller shaft and the forming edge of the roller, progressively increases as the sheet metal moves through station 20, with 52–53 having the smallest angle of deflection and 60–61 having a 90° angle of deflection.

Figure 5:
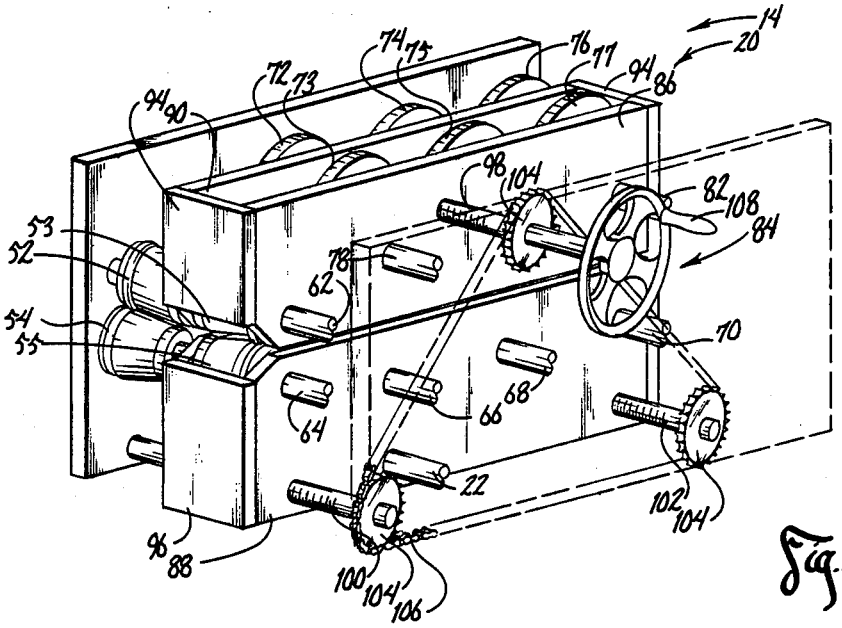
FIG. 5 is a schematic perspective view of the channel forming portion of the machine.
Figure 6:
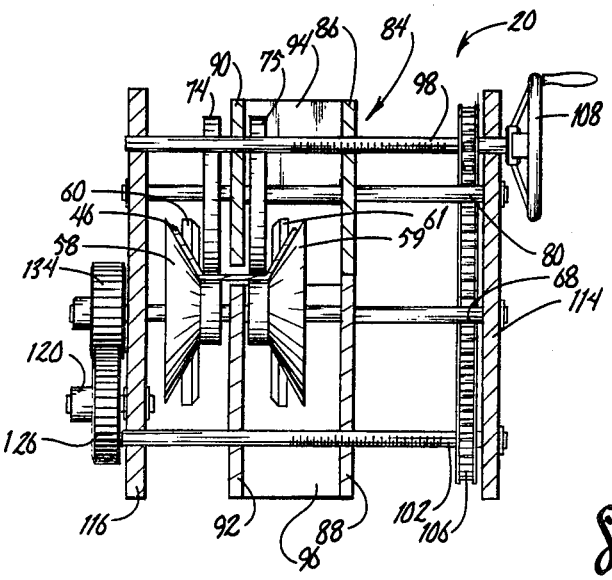
FIG. 6 is a sectional view taken along line 6—6 of FIG. 2.

Looking at FIGS. 5 and 6, channel forming portion 20 has an adjustment means 84 that permits moveable adjustment of forming rollers 53, 55, 57, 59, 61 and guide rollers 73, 75 and 77. Adjustment means 84 includes an upper outer slide plate 86, a lower outer slide plate 88, an upper center slide plate 90, a lower center slide plate 92, upper end plates 94 and lower end plates 96. A first adjusting shaft 98 is threadably received in upper outer slide plate 86 and passes through upper center slide plate 90. Two additional adjustment shafts 100 and 102 are threadably received in the lower corners of lower outer slide plate 88 and pass through lower center slide plate 92. Shafts 98, 100, and 102 are drivingly interconnected by sprockets 104 and chains 106. A hand crank 108 provides easy adjustment of the adjustment means 84.

A power source (not shown) has a main drive shaft 110 which has a gear-pulley 112 mounted thereon. Extending through side plate 116 of machine 14 are shafts 118, 120 and 122 having corresponding sprocketed transfer gears 124, 126 and 128, respectively. Roller shafts 64, 66, 68 and 70 each have sprocketed gears 130, 132, 134 and 136, respectively. Gear-pulley 112 meshes with gears 124 and 126. Gear 124 meshes with roller shaft gears 130 and 132 while gear 126 meshes with roller shaft gears 132 and 134. Gear 128 meshes with roller shaft gears 134 and 136. Thus, the rollers of the forming station 20 are driven in unison by the combination of meshing gears.

Gear-pulley 112 also has a belt 138 that drivingly connects it to gear-pulley 140 mounted on shaft 142 extending between back plate 144 and center plate 146 of the machine 14. Shaft 148 extends between back plate 144 and center plate 146 and has a gear 150 in meshing combination with gear-pulley 140. Shafts **39*a* and 39*b* of advancing rollers 38 span between front plate 143 and back plate 144 of machine 14 and have sprocketed gears 151*a* and 151*b*, respectively, on the exterior of back plate 144. Gear 150 meshes with the gear of shaft 39*a* which in turn meshes with the gear of shaft 39*b*. Extending through back plate 144 and center plate 146 are shafts 152 and 154, each of which has a sprocketed gear 156 and 158 respectively. Gears 156 and 158 are each meshed with gears 160 and 162 mounted on shafts 164 and 166, respectively of clutches 28**. Thus, the clutches and cams are driven in unison by the combination of meshing gears.

It can thus be seen that the new invention accomplishes at least all of its stated ojectives.

What is claimed is:

1. A portable machine for continuously punching, shearing and forming a continuous strip of sheet metal comprising:

an elongated frame having a punching station, a shearing station and a forming station thereon for receiving said strip of sheet metal;

conveyor means for feeding said strip of sheet metal to said punching, shearing and forming stations;

said punching station comprising first and second punching means which are movably mounted for movement from a spaced apart position relative to one another to a punch position relative to one another wherein said first and second punching means will punch a predetermined pattern of holes in said strip of sheet metal;

said first and second punching means being connected to one another and being mounted for reciprocating movement in unison in a longitudinal direction with respect to said frame from a first position to a second position;

a single first actuating member engaging said first and second punching means and being movable to cause said first and second punching means to move toward one another to said punch position and simultaneously to cause said first and second punching means to move longitudinally with respect to said frame to said second position;

said shearing station comprising first and second spaced apart shearing means which are movably mounted for movement from a spaced apart position relative to one another to a shear position wherein said first and second shearing means will shear said continuous strip of sheet metal, said first and second shearing means being connected to one another, and being mounted for reciprocating movement in unison with one another in said longitudinal direction from a first position to a second position:

a single second actuating member engaging said first and second shearing means and being movable to cause said first and second shearing means to move toward one another to said shear position and simultaneously to cause said first and second shearing means to move longitudinally with respect to said frame to said second position; and said forming station including a plurality of forming rollers for engaging said metal strips and forming said strip into a predetermined shape.

2. A machine according to claim 1 wherein one of said first and second punching means includes a punch cam follower surface thereon and one of said first and second shearing means includes a shear cam follower surface thereon, said first actuating member comprising a punch cam adapted to cam against said punch cam follower surface and said second actuating member comprising a shear cam adapted to cam against said shear cam follower surface.

3. A machine according to claim 2 wherein said punch cam and said shear cam each are rotatably mounted to said frame for rotation about a horizontal axis.

4. A machine according to claim 3 wherein said punch cam and said shear cam each include at least one protruding tip which moves in a circular path around said horizontal axis, each of said punch cam follower surface and said shear cam follower surface having a first surface and a second surface adapted to be engaged by said protruding tip of said punch cam and said shear cam respectively.

5. A machine according to claim 4 wherein said first surfaces are approximately horizontal and said second surfaces extend upwardly therefrom.

6. A machine according to claim 1 wherein said punching station includes first punch spring means engaging and yieldably urging said first and second punching means toward said spaced apart position, and second punch spring means engaging and yieldably urging said first and second punching means to said first position, said shearing station including first shear spring means yieldably urging said first and second shear means to said spaced apart position and second shear spring means yieldably urging said first and second shear means to said second position.

7. A machine according to claim 1 wherein said plurality of rollers are arranged in two spaced apart groups, and adjustment means being associated with one of said groups, for permitting selective adjustment of the position of said one group of rollers with respect to the other of said groups of rollers.

8. A machine according to claim 7 wherein said adjustment means comprises a channel, each of said one group of rollers being rotatably mounted to said channel, said channel being selectively movable to cause all of said one group of rollers to move with respect to the other group of said rollers.

9. A machine according to claim 8 wherein said adjustment means further comprises at least one threaded shaft threadably extending through said channel and said frame, and crank means connected to said shaft for rotating said shaft to cause movement to said channel.

10. A method of continuously punching, shearing and forming sheet material using a portable machine having a punch station, a shear station, and a forming station said method comprising:

feeding said sheet material in a feed direction between first and second punching means at said punching station; engaging said first and second punching means with a single movable punch actuating member so as to cause said first and second punching means to move toward one another and punch a predetermined pattern of holes in said sheet material and so as to simultaneously cause said first and second punching means to move in said feed direction in unison with said sheet material during said punching process;

feeding said sheet material continuously from said punch station to said shear station between first and second shearing means at said shearing station;

engaging said first and second shearing means with a single movable shear actuating member so as to cause said first and second shearing means to move toward one another and to shear said sheet material and so as to simultaneously cause said first and second shear means to move to said feed direction in unison with said sheet material during said shearing process;

feeding said sheet material continuously from said shear station staton to said forming station; and forming said sheet material into a predetermined shape with a plurality of forming rollers at said forming station.

11. A method accrording to claim 10 wherein said plurality of forming rollers are divided into a first group and a second group which are spaced apart from one another, said method further comprising selectively adjusting the distance between said first group and second group of rollers by moving one of said groups as a unit with respect to the other of said groups.

* * * * *